US008720687B2

(12) United States Patent
Hassell

(10) Patent No.: US 8,720,687 B2
(45) Date of Patent: May 13, 2014

(54) BAKERY TRAY

(75) Inventor: Jon P. Hassell, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 705 days.

(21) Appl. No.: 12/496,047

(22) Filed: Jul. 1, 2009

(65) Prior Publication Data

US 2010/0000900 A1 Jan. 7, 2010

Related U.S. Application Data

(60) Provisional application No. 61/077,481, filed on Jul. 1, 2008.

(51) Int. Cl.
*B65D 21/06* (2006.01)
*B65D 21/04* (2006.01)

(52) U.S. Cl.
USPC ..... 206/507; 206/506; 206/509; 206/505

(58) Field of Classification Search
USPC ..... 206/507, 509, 511, 512; 220/DIG. 6, 220/DIG. 2
See application file for complete search history.

(56) References Cited

U.S. PATENT DOCUMENTS

| | | | | |
|---|---|---|---|---|
| RE26,350 | E | | 2/1968 | Wilson |
| 3,420,402 | A | | 1/1969 | Frater et al. |
| 3,438,544 | A | | 4/1969 | Cloyd |
| 3,613,943 | A | | 10/1971 | Bridenstine |
| D224,366 | S | | 7/1972 | Rehrig |
| 3,675,815 | A | | 7/1972 | Rehrig |
| 3,780,905 | A | | 12/1973 | Herolzer |
| 3,825,114 | A | | 7/1974 | Johnson et al. |
| 3,865,239 | A | | 2/1975 | Herolzer et al. |
| 3,937,327 | A | | 2/1976 | Carroll |
| 3,951,265 | A | * | 4/1976 | Carroll ..... 206/506 |
| 4,000,817 | A | | 1/1977 | Sanders et al. |
| 4,023,680 | A | | 5/1977 | Thurman |
| D247,648 | S | | 3/1978 | Carroll et al. |
| 4,093,070 | A | * | 6/1978 | Stahl ..... 206/507 |
| 4,093,071 | A | | 6/1978 | Stahl et al. |
| 4,102,453 | A | | 7/1978 | Carroll et al. |
| D249,185 | S | | 8/1978 | Carroll et al. |
| 4,106,624 | A | | 8/1978 | Thurman |
| 4,106,625 | A | | 8/1978 | Carroll et al. |
| 4,109,791 | A | | 8/1978 | Clipson et al. |
| 4,189,052 | A | * | 2/1980 | Carroll et al. ..... 206/507 |
| 4,238,032 | A | * | 12/1980 | Thurman ..... 206/507 |

(Continued)

FOREIGN PATENT DOCUMENTS

| | | |
|---|---|---|
| CA | 2408247 | 11/2001 |
| CA | 2448920 | 7/2004 |
| WO | 0130660 | 5/2001 |

OTHER PUBLICATIONS

European Search Report for EP Application No. 09164349.4, Aug. 18, 2009.

*Primary Examiner* — J. Gregory Pickett
*Assistant Examiner* — Chetan Chandra
(74) *Attorney, Agent, or Firm* — Carlson, Gaskey & Olds

(57) ABSTRACT

A tray includes a base having opposed front and rear walls and opposed side walls. The front and rear walls are shorter to provide access to products stored on the tray when in a stacked configuration. The tray includes reinforced intersections between the front and rear walls and side walls.

5 Claims, 24 Drawing Sheets

(56) References Cited

U.S. PATENT DOCUMENTS

| | | | | | |
|---|---|---|---|---|---|
| 4,320,837 | A | * | 3/1982 | Carroll et al. | 206/505 |
| 4,364,477 | A | | 12/1982 | Stromberg | |
| 4,379,508 | A | | 4/1983 | Miller et al. | |
| 4,423,813 | A | | 1/1984 | Kreeger | |
| 4,519,503 | A | | 5/1985 | Wilson | |
| 4,523,681 | A | | 6/1985 | Kreeger | |
| 4,759,451 | A | | 7/1988 | Apps | |
| 4,807,756 | A | * | 2/1989 | Young et al. | 206/509 |
| 4,936,458 | A | * | 6/1990 | Tabler et al. | 206/507 |
| 4,960,207 | A | | 10/1990 | Tabler et al. | |
| 4,982,844 | A | * | 1/1991 | Madan et al. | 206/506 |
| 5,035,326 | A | * | 7/1991 | Stahl | 206/507 |
| D319,908 | S | | 9/1991 | Stahl | |
| 5,287,966 | A | * | 2/1994 | Stahl | 206/509 |
| D348,138 | S | | 6/1994 | Lang-Ree et al. | |
| D348,344 | S | | 6/1994 | Apps | |
| D350,028 | S | | 8/1994 | Apps | |
| 5,344,022 | A | * | 9/1994 | Stahl | 206/507 |
| 5,372,257 | A | | 12/1994 | Beauchamp et al. | |
| 5,582,296 | A | * | 12/1996 | Beauchamp et al. | 206/503 |
| 5,881,902 | A | * | 3/1999 | Ackermann | 206/509 |
| 5,896,992 | A | * | 4/1999 | McGrath | 206/507 |
| 5,921,566 | A | | 7/1999 | Kern et al. | |
| 5,979,654 | A | | 11/1999 | Apps | |
| D439,049 | S | | 3/2001 | Koefelda | |
| 6,260,706 | B1 | * | 7/2001 | Koefelda | 206/505 |
| D446,939 | S | | 8/2001 | Koefelda | |
| 6,273,259 | B1 | * | 8/2001 | Stahl | 206/511 |
| 6,394,274 | B1 | * | 5/2002 | Cheeseman | 206/511 |
| 6,607,199 | B2 | * | 8/2003 | Gruber | 280/33.991 |
| 6,857,642 | B2 | | 2/2005 | Gruber | |
| 6,886,710 | B2 | | 5/2005 | Verna et al. | |
| 6,953,116 | B2 | | 10/2005 | Verna et al. | |
| 7,320,405 | B2 | * | 1/2008 | Stahl | 206/509 |
| 7,484,621 | B2 | | 2/2009 | Apps | |
| D598,684 | S | * | 8/2009 | Stahl | D6/511 |
| 7,637,373 | B2 | | 12/2009 | Stahl | |
| 7,686,167 | B1 | * | 3/2010 | Stahl | 206/507 |
| 7,784,615 | B2 | | 8/2010 | Stahl | |
| 7,861,864 | B2 | | 1/2011 | Hassell et al. | |
| 2002/0153682 | A1 | | 10/2002 | Gruber | |
| 2003/0183549 | A1 | * | 10/2003 | Verna et al. | 206/509 |
| 2003/0205495 | A1 | * | 11/2003 | Verna et al. | 206/509 |
| 2004/0050742 | A1 | * | 3/2004 | Gruber | 206/509 |
| 2004/0060844 | A1 | | 4/2004 | Stahl | |
| 2004/0144680 | A1 | * | 7/2004 | Stahl | 206/512 |
| 2005/0183980 | A1 | * | 8/2005 | Fernandez et al. | 206/509 |
| 2006/0070906 | A1 | * | 4/2006 | Verna et al. | 206/509 |
| 2007/0187276 | A1 | | 8/2007 | Stahl | |
| 2008/0116100 | A1 | | 5/2008 | Hassell et al. | |
| 2010/0084304 | A1 | | 4/2010 | Cavalcante | |
| 2011/0037237 | A1 | | 2/2011 | Hassell | |

* cited by examiner

BAKERY TRAY

This application claims priority to U.S. Provisional Application Ser. No. 61/077,481, filed Jul. 1, 2008.

BACKGROUND OF THE INVENTION

The present invention relates generally to a tray for baked goods,

Existing molded plastic trays for shipping and storing baked goods include opposite side walls extending upwardly from a base. Front and rear walls are lower than the side walls in order to provide access to the baked goods when the trays are stacked. The side walls include rails that permit the trays to slide and interlock with one another for stacking.

In use, the trays, while loaded with baked goods, are often stacked higher than the person stacking and unstacking them. When the person lifts a loaded tray onto a stack above his head, this is known as "blind stacking." The person can set a rear edge of the tray onto a front edge of the top tray on the stack and slide the tray rearward until it interlocks with the top tray.

In the current trays, some of the projections on the tray that interlock with the upper edges of the tray below are susceptible to breakage. Further, the shorter front and rear walls of the tray reduce the strength of the tray, particularly when supporting hot baked goods. Thus, the current trays are susceptible to breakage.

SUMMARY

A tray according to one embodiment of the present invention includes a base, a pair of opposed side walls, a front wall and a rear wall. The side walls each include an outer rail and an inner rail and a plurality of recesses. Each side wall further includes a plurality of feet aligned such that the feet of an identical tray would stack at a first height when stacked in a first orientation relative to the tray and at a second height when stacked at a second orientation relative to the tray.

The front wall is shorter than the side walls to provide access to an interior of the tray. The front wall has a lip projecting outwardly and downwardly from an upper edge of the front wall. The lip includes enlarged portions proximate the side walls to reinforce the tray.

DETAILED DESCRIPTION OF THE PREFERRED EMBODIMENT

Figure 1:
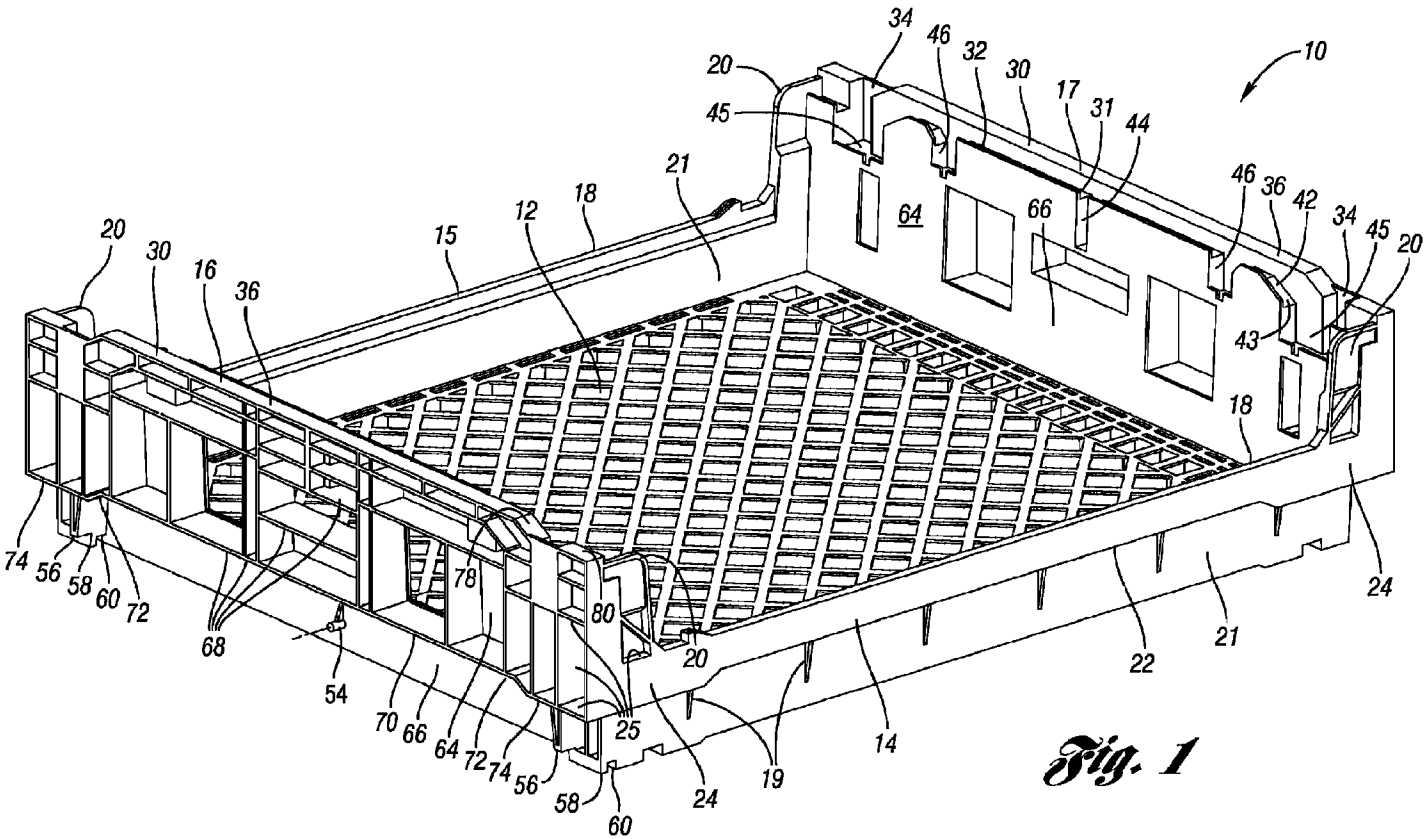
FIG. 1 is a perspective view of a tray according to a first embodiment of the present invention.

A tray 10 according to one embodiment of the present invention is shown in FIG. 1. The tray 10 includes a base 12, a front wall 14, a rear wall 15 and opposite side walls 16, 17. The front and rear walls 14, 15 are shorter than the side walls 16, 17 (e.g. less than half the height) to create an access window 18, so that the goods stored on the base 12 can be accessed even when additional, similar trays are stacked on the tray 10. Lateral flanges 20 extend inward from the side walls 16, 17, slightly narrowing the windows 18 in order to reinforce the corner intersections between the front and rear walls 14, 15 and the side walls 16, 17.

The front and rear walls 14, 15 each include an inner wall 21 continuous with the base 12 and an outwardly spaced outer wall or lip 22 providing structural reinforcement to the front and rear walls 14, 15. Ribs or gussets 19 connect the inner wall 21 and lip 22. The lip 22 includes enlarged portions 24 proximate the side walls 16, 17. The enlarged portions 24 are, together with ribs 25, part of the tubular or box beam cross-sections that extend from the front and rear walls 14, 15 into the corners adjacent the side walls 16, 17. The enlarged portions 24 and box beam cross-sections reinforce the corners of the tray 10 to prevent breakage in corners.

The side walls 16, 17 each include an outer rail 30 and a lower, inner rail 32. The outer rail 30 is continuous with interlocking recesses 34 for mating with feet 56, 57 on a similar tray 10 stacked thereon. The upper surface 36 of the outer rail 30 is aligned with the recesses 34.

Figure 2:
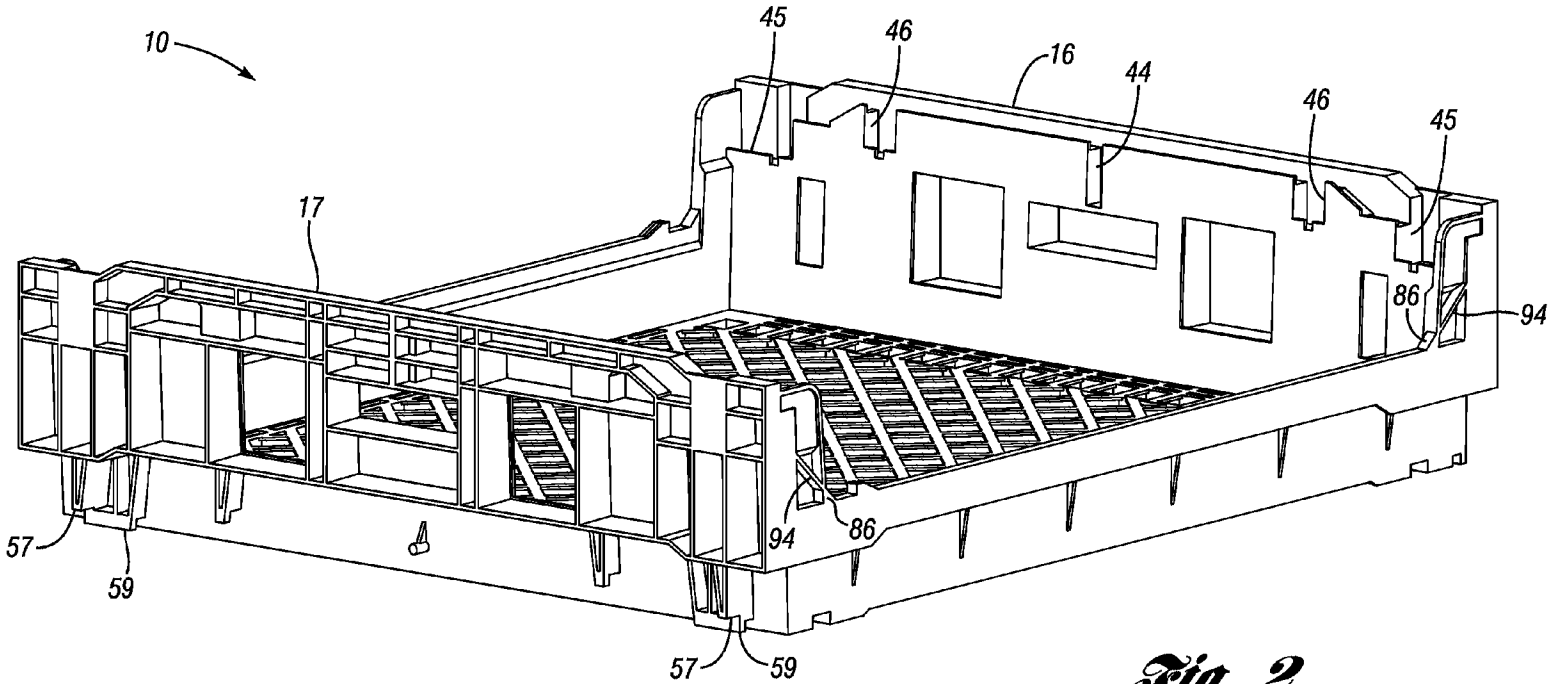
FIG. 2 is a perspective view of the opposite side of the tray of FIG. 1.

A channel 31 defined between the inner rail 32 and the outer rail 30 includes a bottom surface 42 having inclined portions 43. A central opening 44 to the interior of the tray 10 interrupts the channel 31 and the inner rail 32 and the surface 42 to provide drainage of the channel 31 when the tray 10 is washed and to accommodate an optional central projection 54 in similar trays 10 stacked thereon. Outer pockets 45 and inner pockets 46 are defined in the channel 31 and in the surface 42 through the inner rail 32. As is known in trays 10 of this type, the space between the various recesses, openings and surfaces is different on the side wall 17 (shown in FIG. 1) and that of side wall 16 (shown in FIG. 2).

Figure 3:
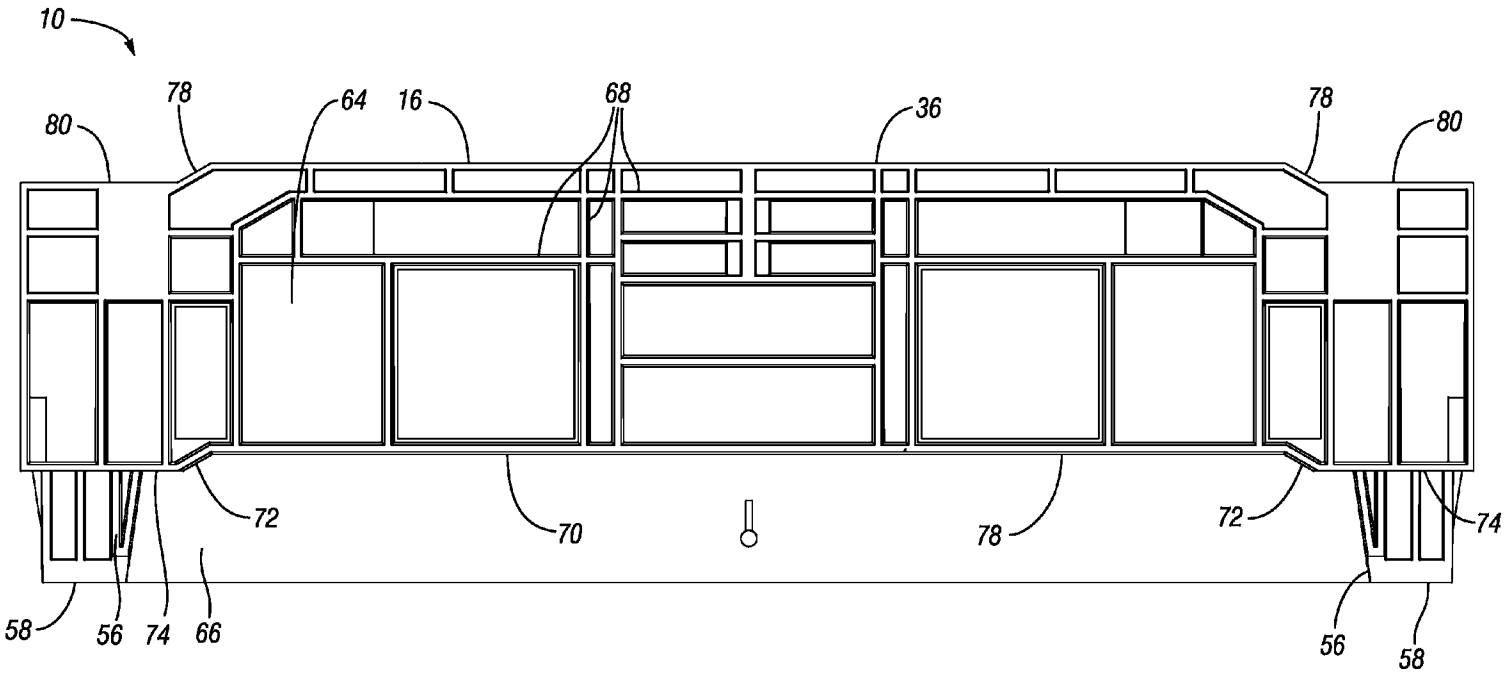
FIG. 3 is a side view of the tray of FIG. 1.
Figure 4:
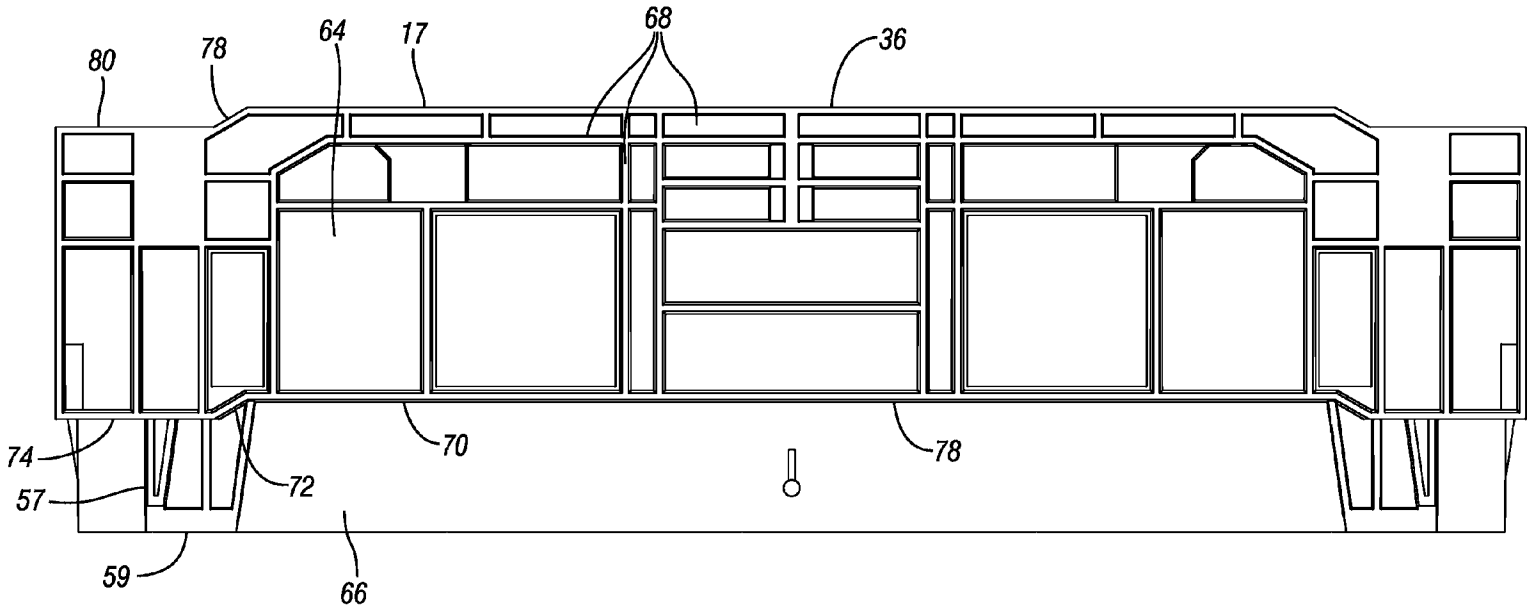
FIG. 4 is the opposite side view of the tray of FIG. 3.

Referring to FIGS. 3 and 4, in a lower portion of the side walls 16, 17, outer feet 56, 57 project downwardly and are aligned with the upper surface 36 of the outer rail 30. An inner guide 58, 59 is spaced inwardly from each foot 56 and extends downwardly further than each foot 56. Each inner guide 58, 59 includes a notch 60 vertically aligned with the inner rail 32.

The side walls 16, 17 each include a generally planar, generally vertical wall 64 with various openings therethrough and having a lower wall portion 66 directly connected to the base 12. The side walls 16, 17 also include a plurality of interconnected vertical, horizontal and angled ribs 68 extending outwardly from the wall 64, some of which circumscribe openings through the wall 64. The ribs 68 include a lower horizontal central rib 70 extending across most of the side wall 16, 17 and continuous with downwardly-angled ribs 72 and horizontal outer ribs 74.

The ribs 68 further include the upper surface 36 of the guide rail 30, which is the uppermost surface of the side wall 16, 17, downwardly-angled upper ribs 78 and horizontal outer upper ribs 80.

The central rib 70 is spaced higher from the floor than are the outer ribs 74. This defines a central side recess 78 between the central rib 70, the downwardly-angled ribs 72 and the lower wall portion 66. This central side recess 78 is substantially complementary to the upper profile of the side wall 16, 17, including the upper surface 36 of the guide rail 30, downwardly-angled upper ribs 78 and horizontal outer upper ribs 80.

Figure 7:
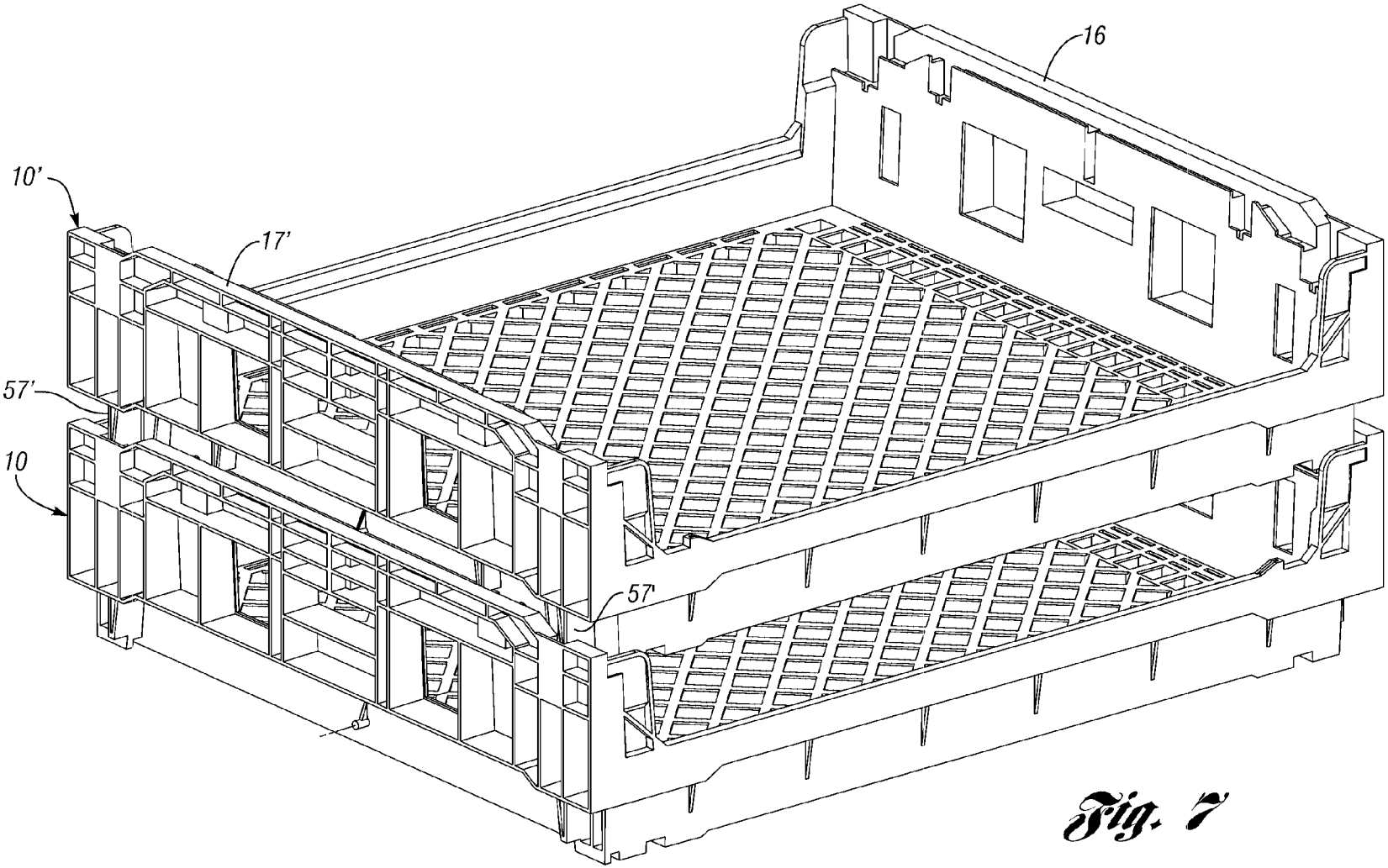
FIG. 7 shows the tray of FIG. 1 and a similar tray in a high stack position.
Figure 8:
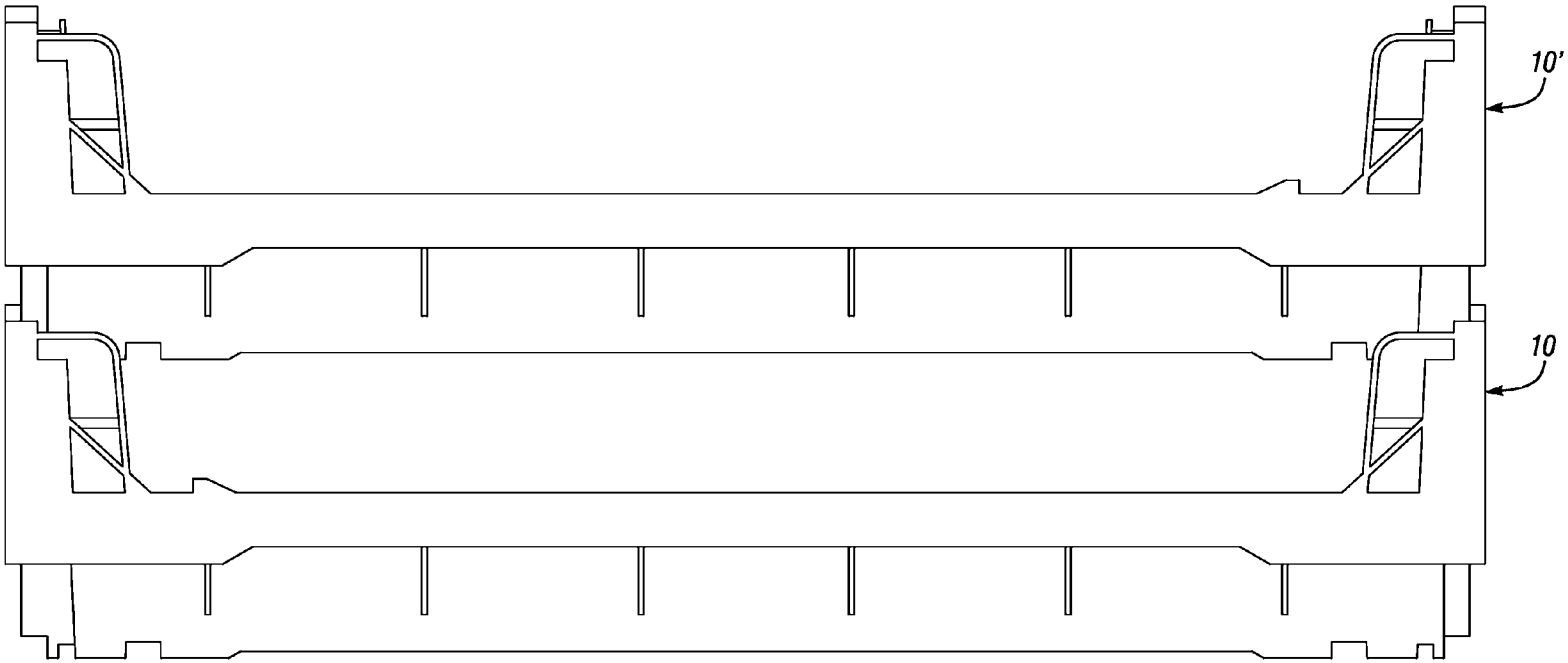
FIG. 8 is a front view of the trays of FIG. 7.
Figure 9:
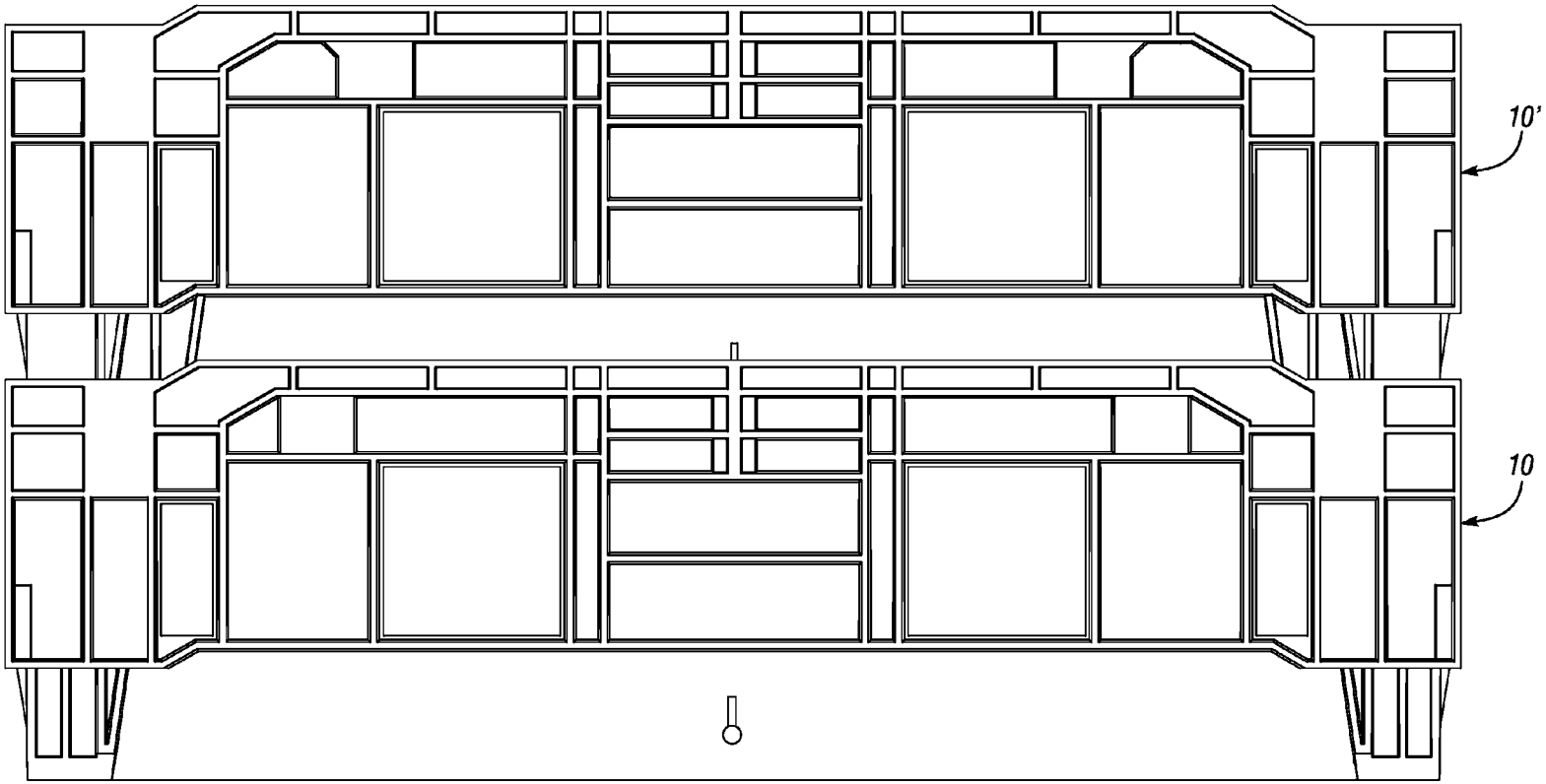
FIG. 9 is a side view of the trays of FIG. 7.
Figure 10:
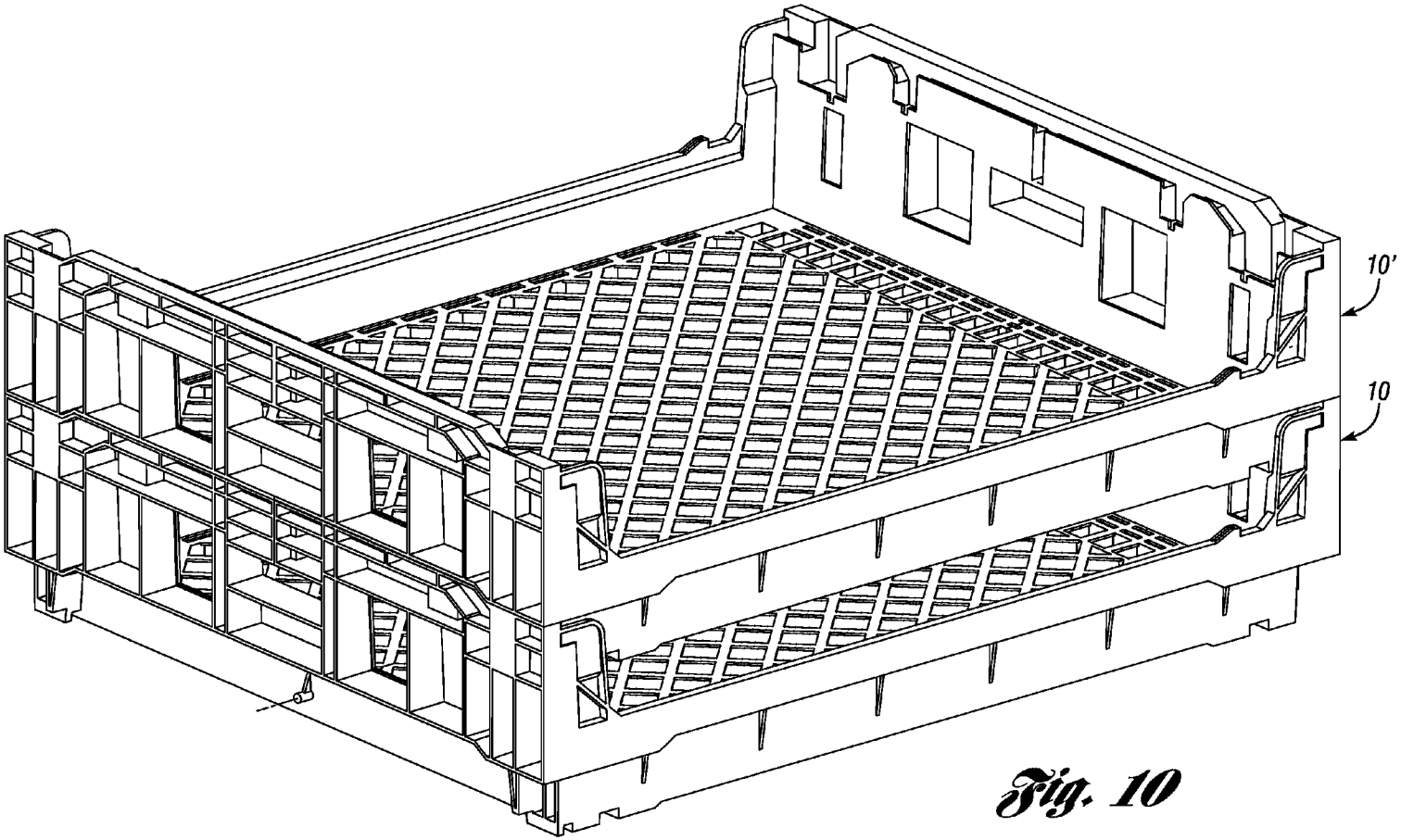
FIG. 10 shows the trays of FIG. 7 in a low stack position.
Figure 11:
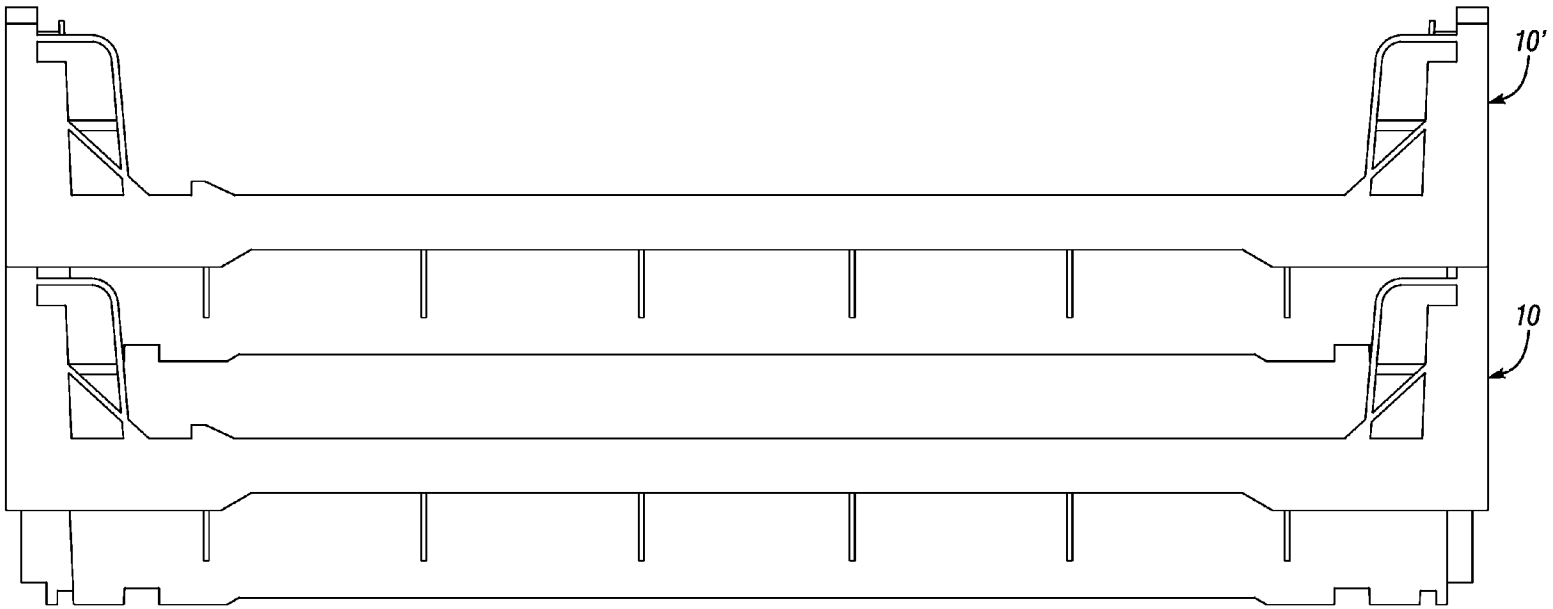
FIG. 11 is a front view of the trays of FIG. 10.
Figure 12:
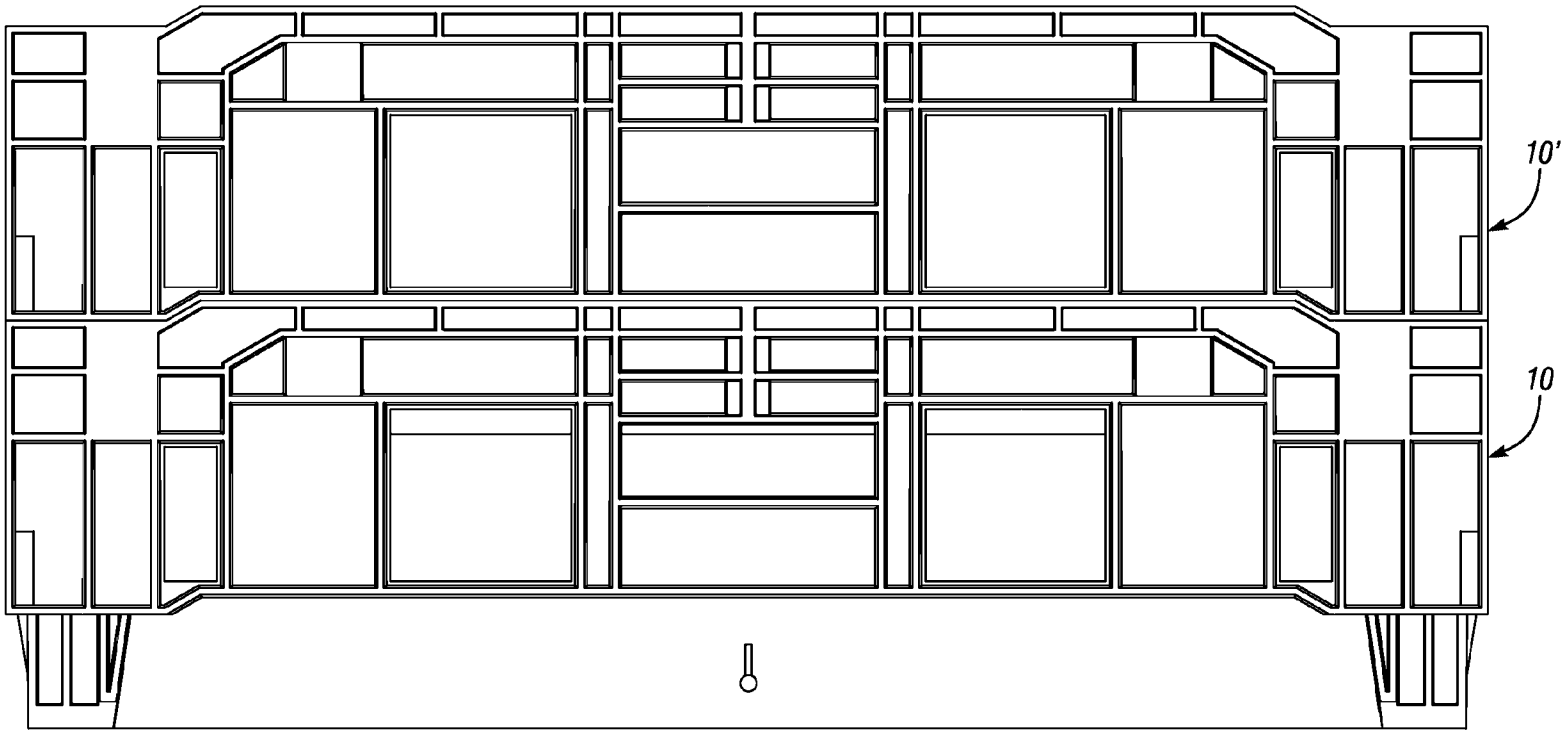
FIG. 12 is a side view of the trays of FIG. 10.

The feet 56, 57 and the inner guides 58, 59 extend outwardly from the lower wall portion 66 and extend downwardly from the horizontal outer ribs 74. As shown by comparing FIGS. 3 and 4, the feet 56, 57 on the side walls 16, 17, respectively, have different spacing on the side walls 16, 17. As a result, in one orientation, with the side wall 17' of an upper tray 10' oriented on the side wall 16 of a lower tray 10, as shown in FIGS. 7-9, the trays 10, 10' stack in the high position. In the opposite orientation, with the side walls 16, 16' aligned, the trays 10, 10' stack in a low position, as shown in FIGS. 10-12. Referring to FIG. 12, in the low stack position, the ribs 70', 36 of the stacked side walls 16', 16 have a gap between them, caused by the position of the horizontal outer upper ribs 80. This permits the enlarged portions 24 of the lip 22 to extend downward further, which further reinforces the corner of the tray 10.

Figure 5:
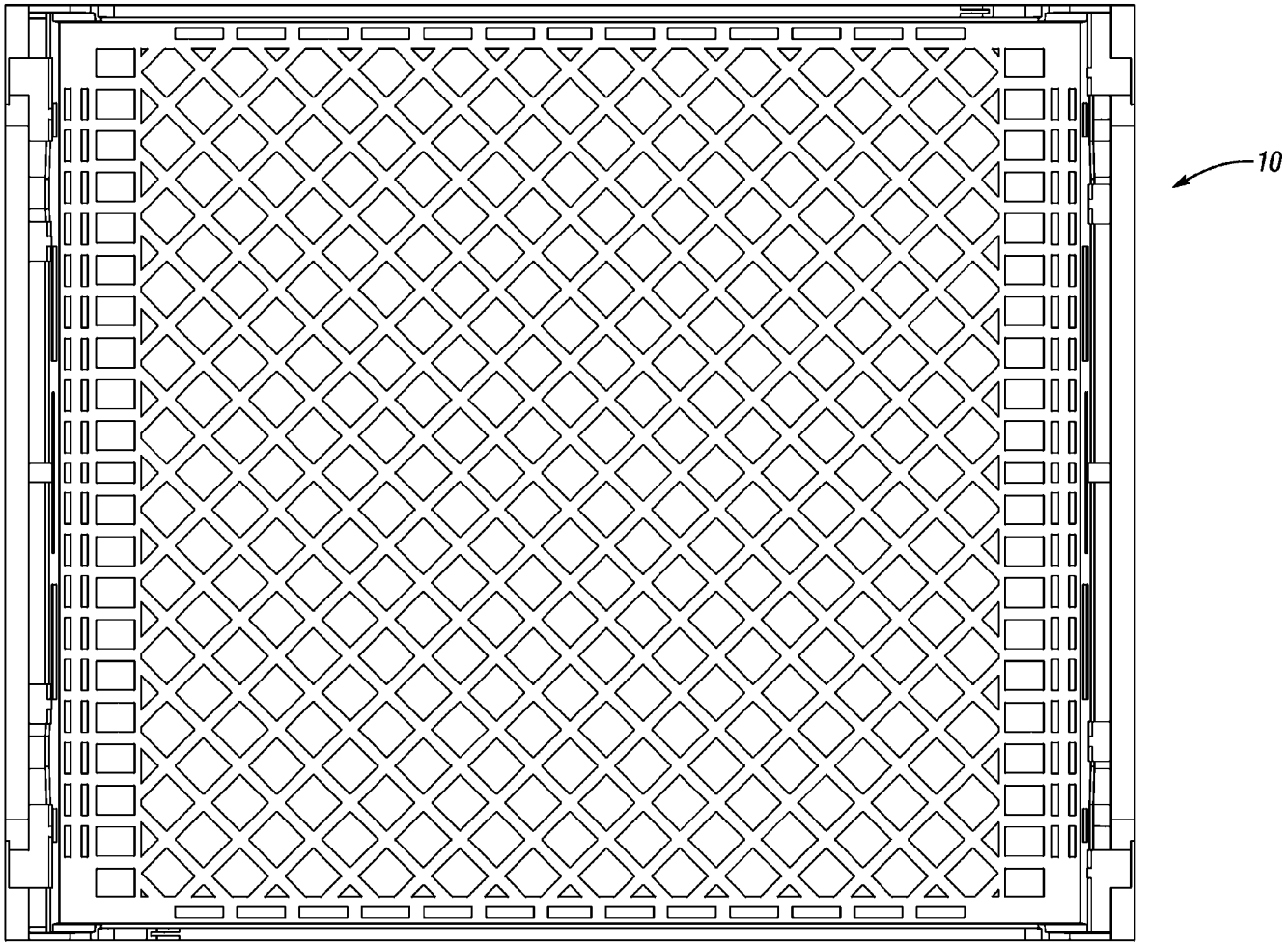
FIG. 5 is a top view of the tray of FIG. 1.
Figure 6:
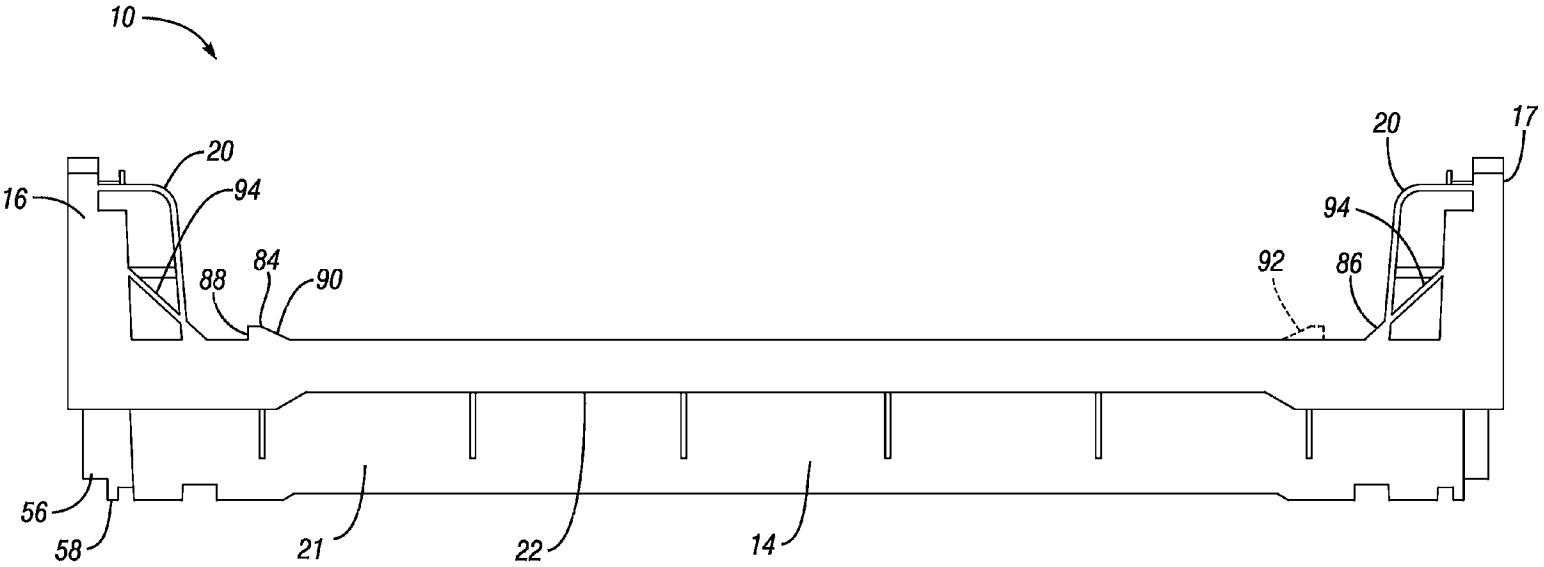
FIG. 6 is a front view of the tray of FIG. 1.

FIG. 5 is a top view of the tray 10. FIG. 6 is a front view of the tray 10. Adjacent each wall 16, 17, an angled gusset 86 connects the front wall 14 to the flange 20. The gussets 86 are continuous with angled ribs 94 tied back to upper portions of the side walls 16, 17. This further reinforces the corners between the side walls 16, 17 and the front wall 14 (and similar gussets 86 and angled ribs 94 connect the side walls 16, 17 to the rear wall 15; see FIG. 2).

Near at least one of the walls 16, 17, a tab 84 is spaced away from the flange 20. The tab 84 includes a vertical edge 88 toward the flange 20 and an angled edge 90 toward the center of the front wall 14. The tabs 84 on the front and rear walls 14, 15 may be near opposite corners, so that different-size trays will not cross-stack stably on the tray 10, thus discouraging users from cross-stacking different-size trays. The tab 84 may also increase the stability of cross-stacked trays 10, where the front and rear walls 14, 15 of an upper tray 10 are oriented between the side walls 14 of the lower tray 10. The front wall 14 may include an optional second tab 92 near the other side wall 14 (oriented opposite that of the tab 84).

Figure 13:
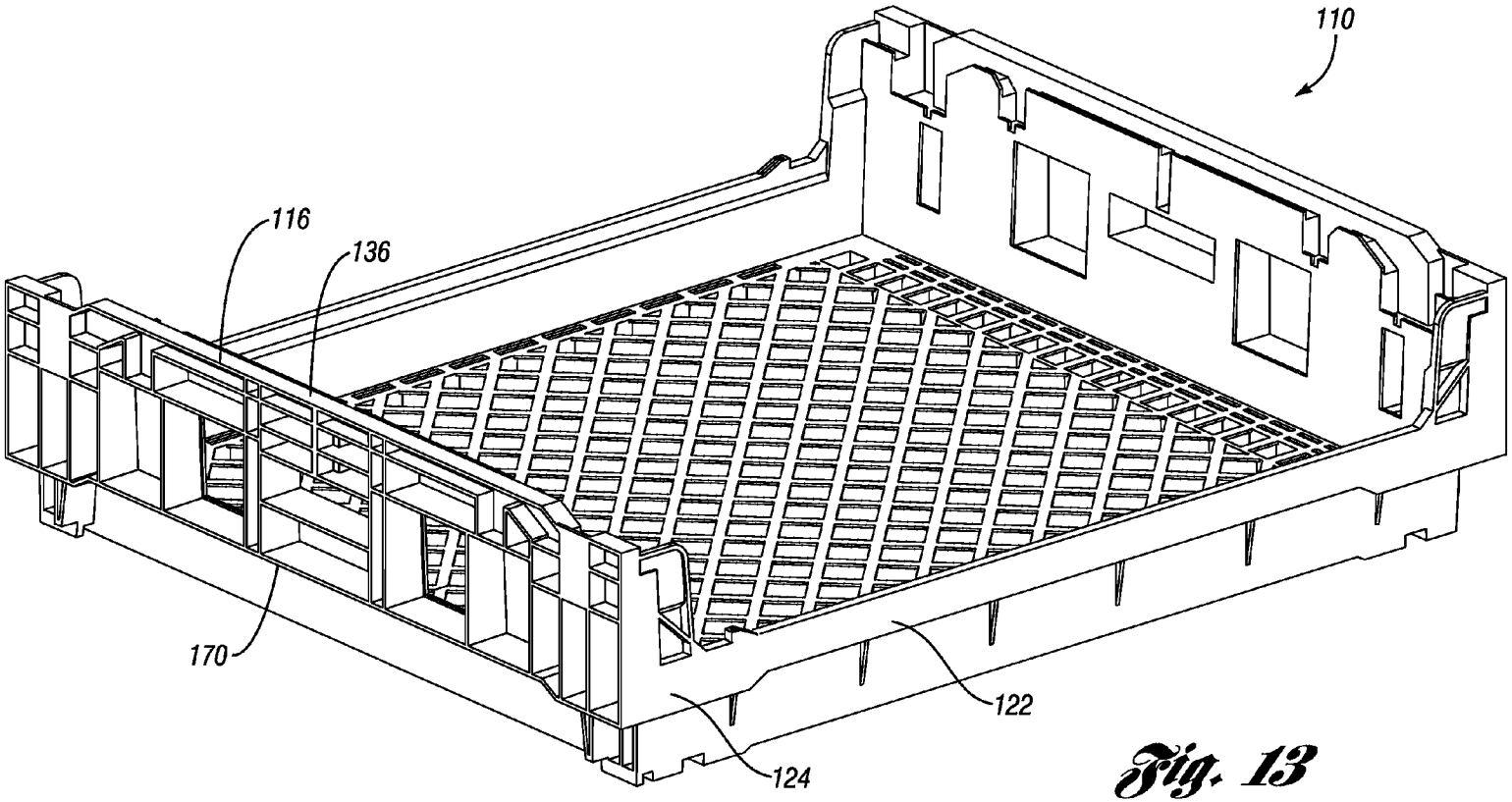
FIG. 13 is a perspective view of a tray according to a second embodiment of the present invention.
Figure 14:
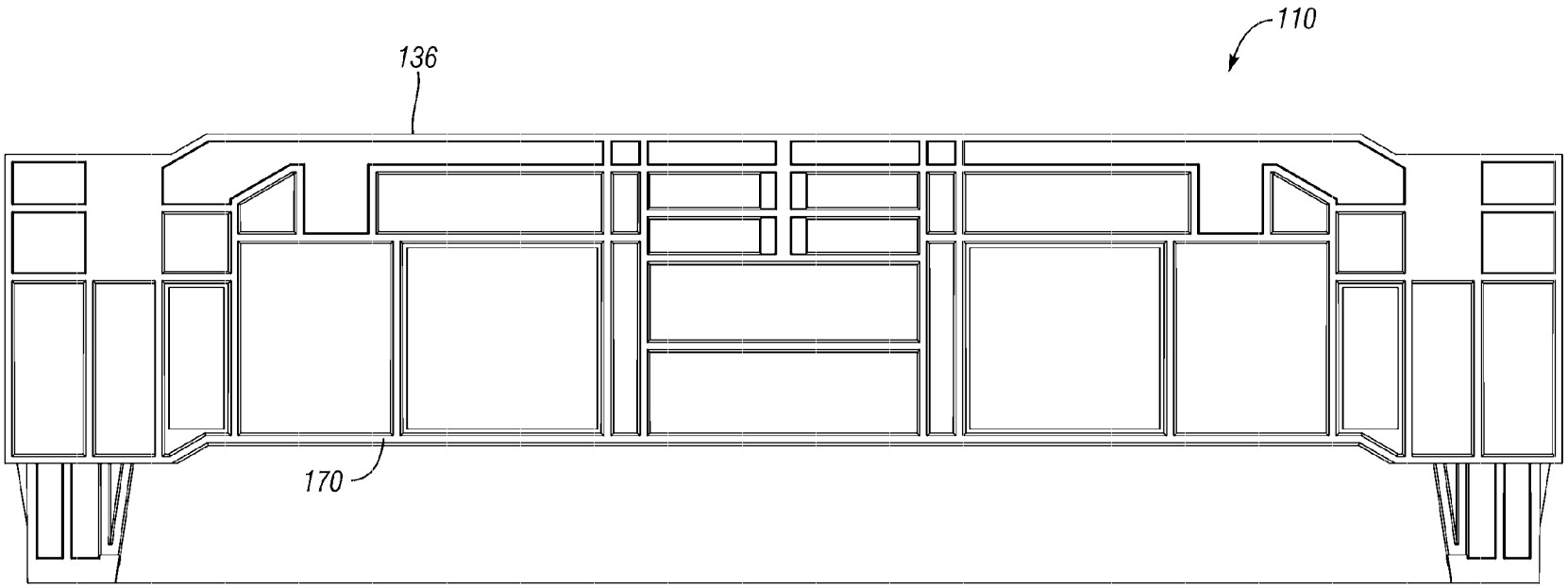
FIG. 14 is a side view of the tray of FIG. 13.
Figure 15:
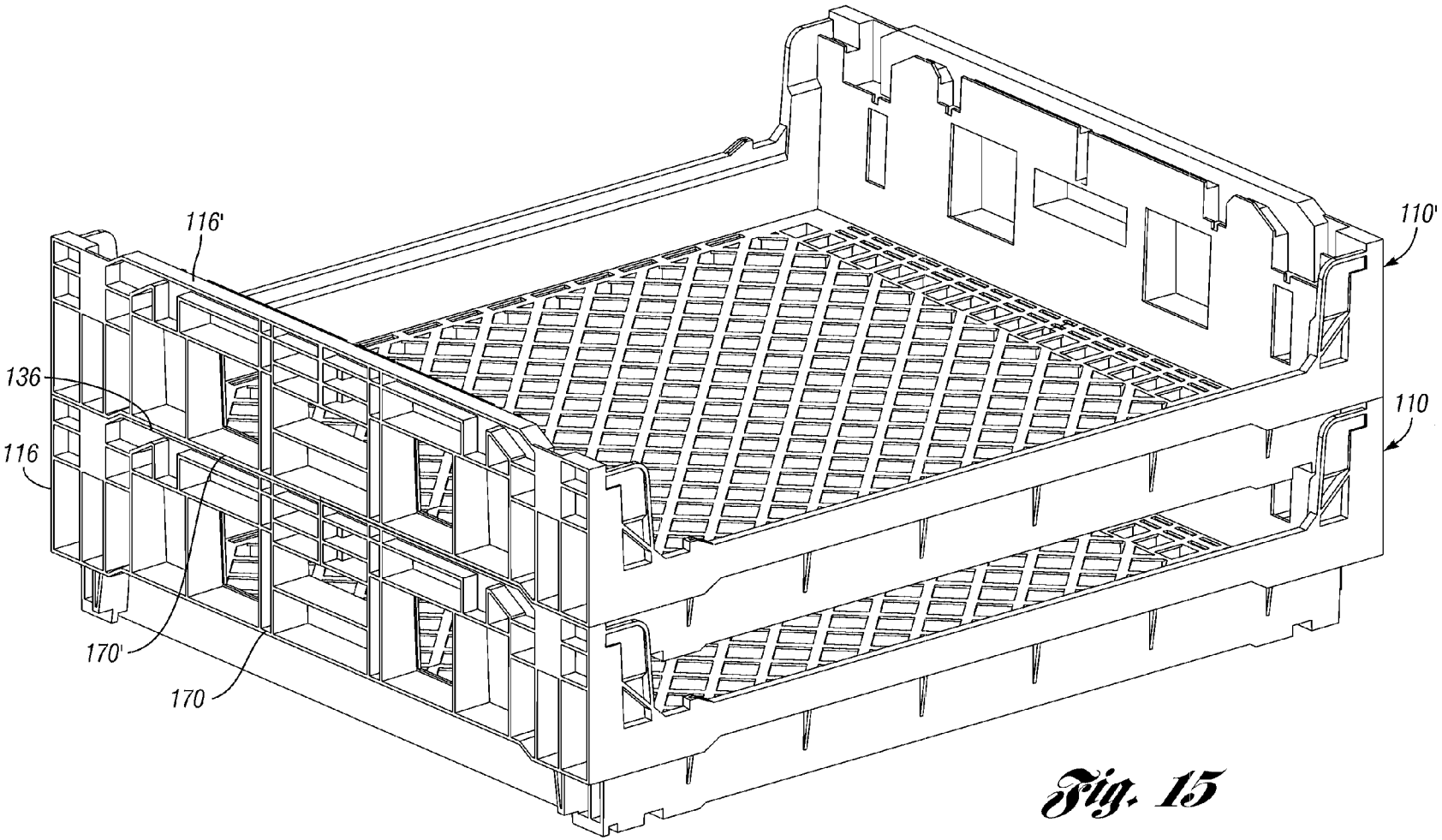
FIG. 15 shows the tray of FIG. 13 and a similar tray in a low stack position.
Figure 16:
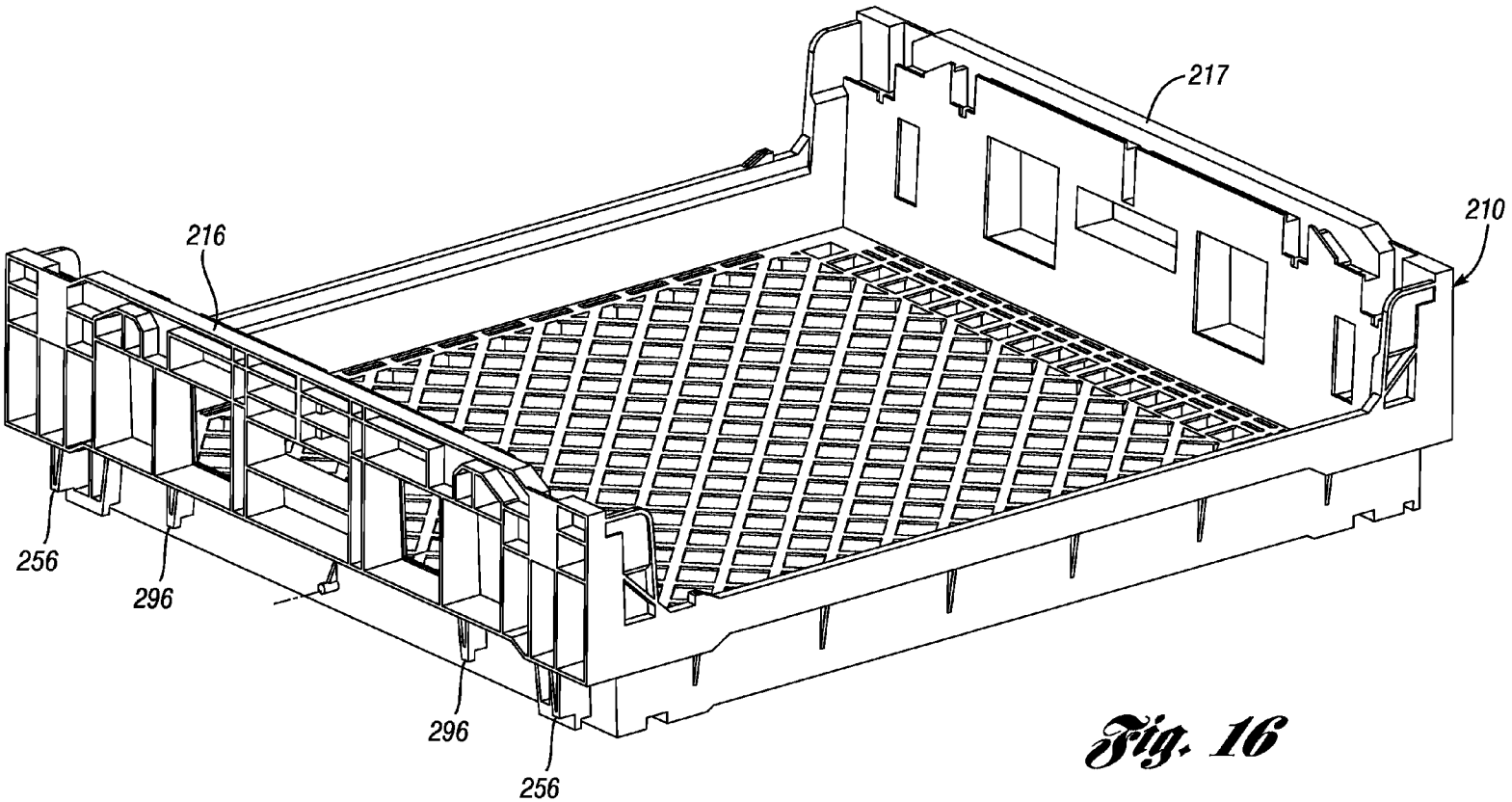
FIG. 16 is a perspective view of a tray according to a third embodiment of the present invention.
Figure 17:
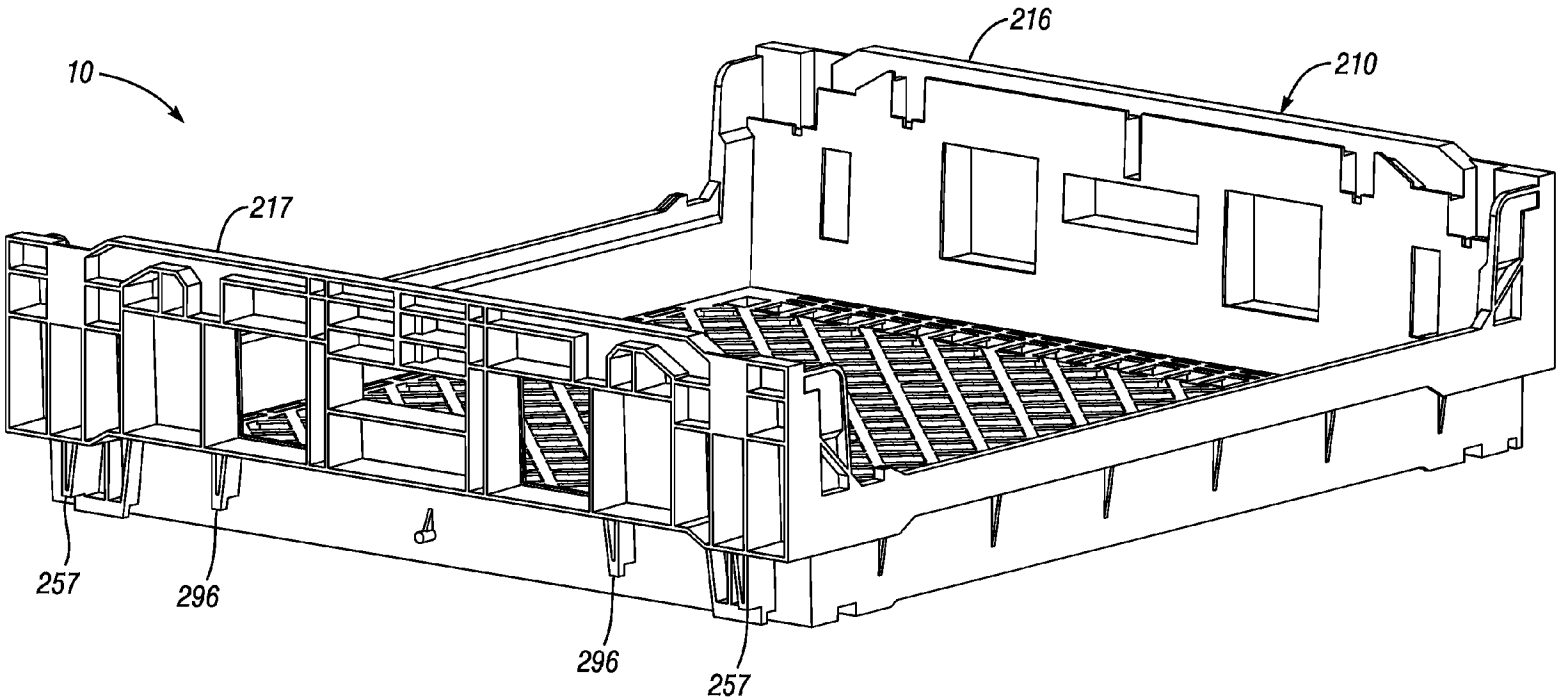
FIG. 17 is a perspective view of the opposite side of the tray of FIG. 16.
Figure 18:
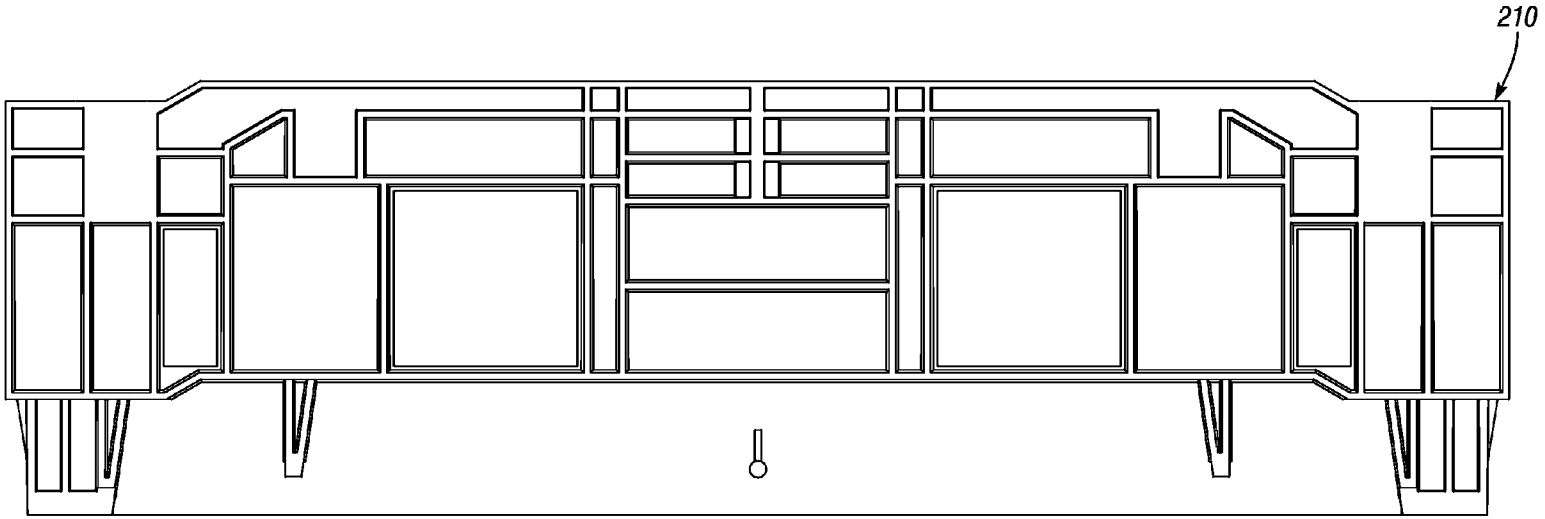
FIG. 18 is a side view of the tray of FIG. 16.
Figure 19:
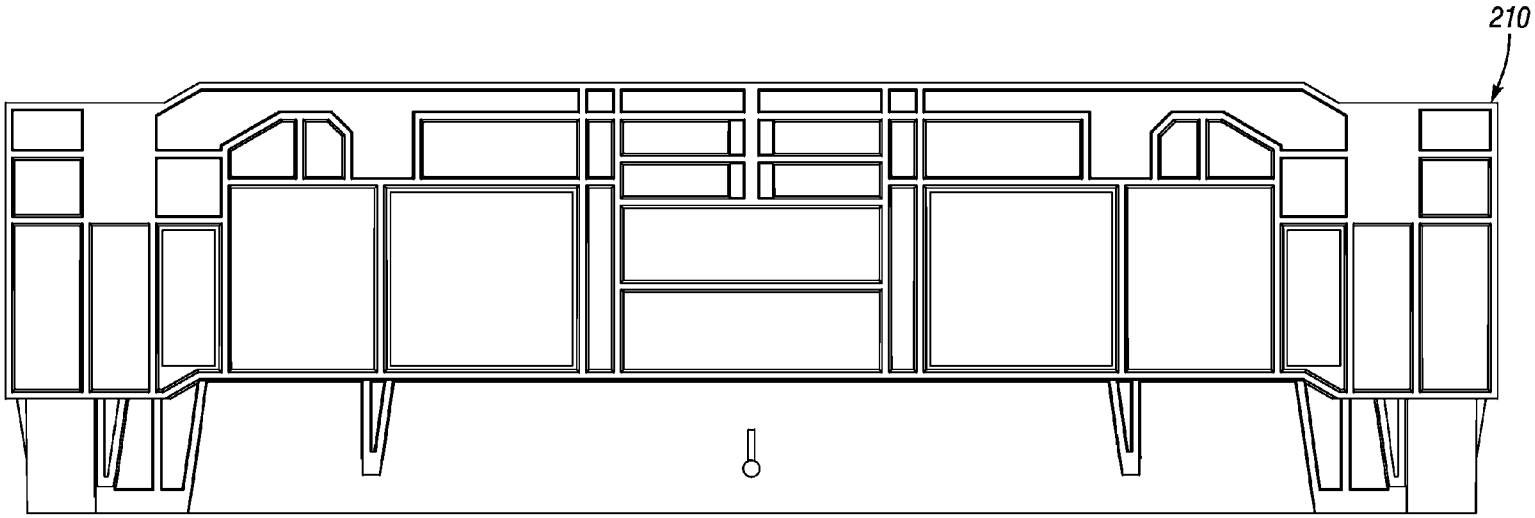
FIG. 19 is an opposite side view of the tray of FIG. 16.
Figure 20:
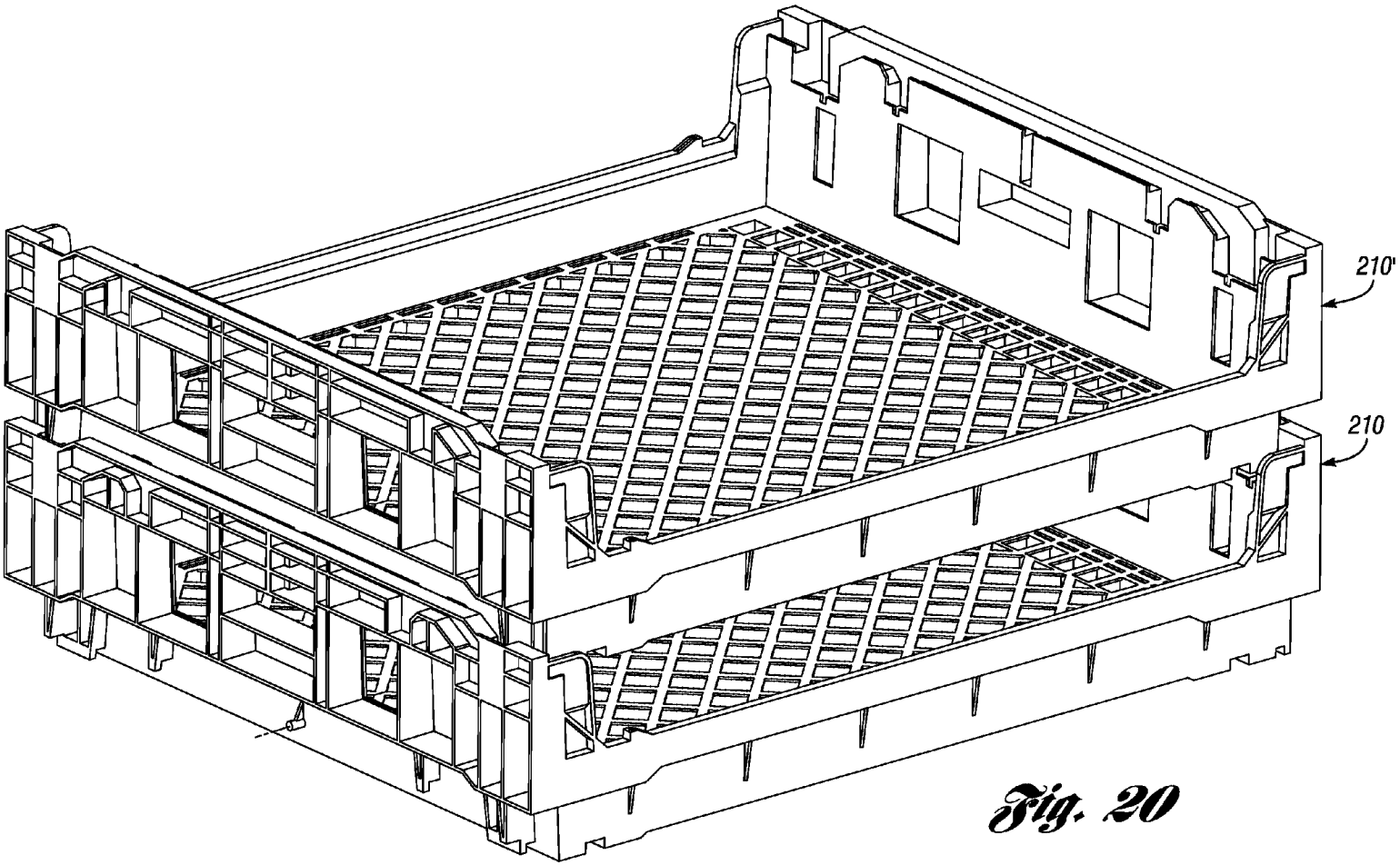
FIG. 20 shows the tray of FIG. 16 and a similar tray in a high stack position.
Figure 21:
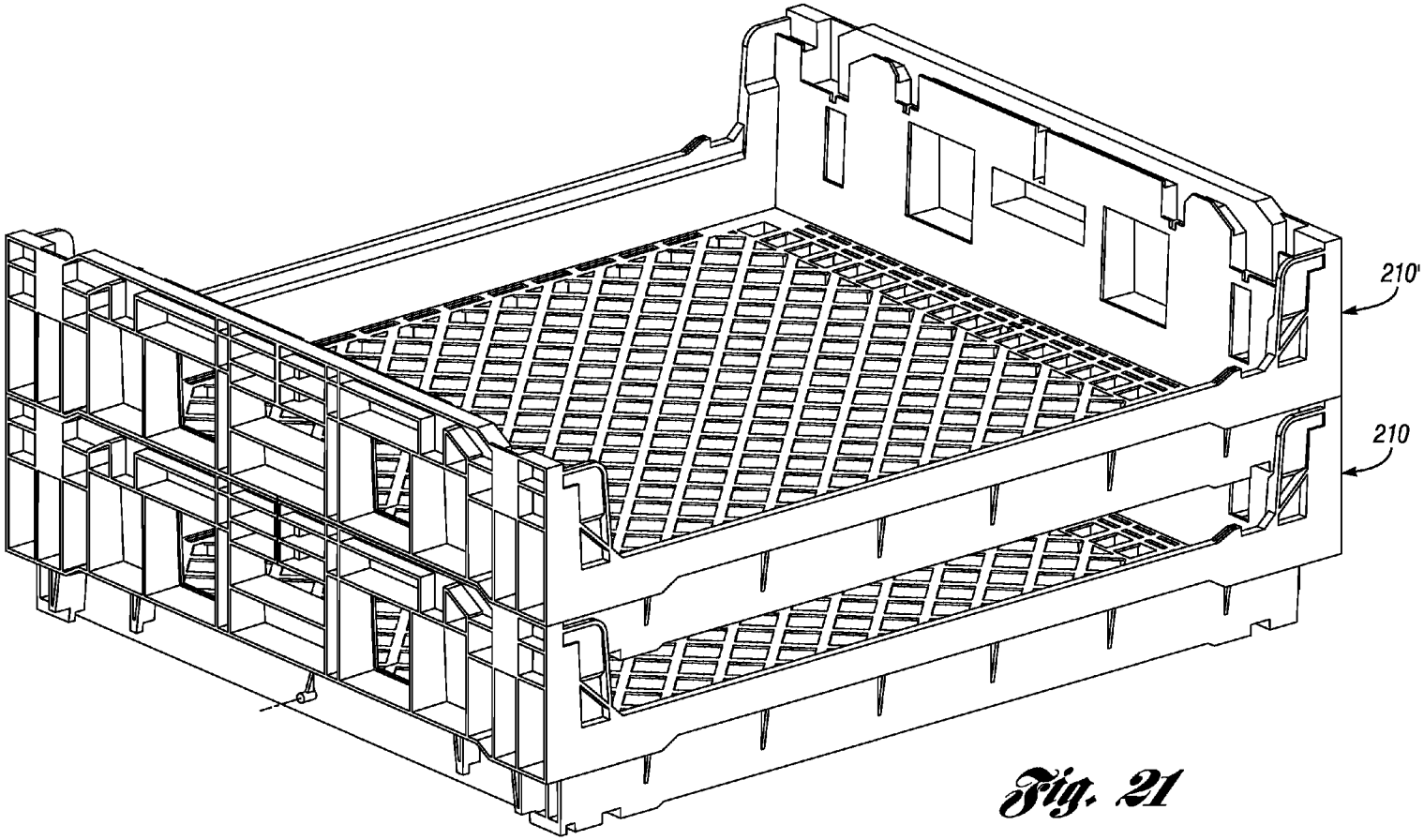
FIG. 21 shows the trays of FIG. 20 in a low stack position.

FIGS. 13-15 illustrate a tray 110 according to a second embodiment, which is similar to the first embodiment with the following modifications. First, the second embodiment does not include the central projection 54 (FIG. 1). Additionally, in the low stack position (FIG. 15), there is no significant gap between the central rib 170' of the side wall 116' of the upper tray 110' and the upper surface 136 of the side wall 116 of the lower tray 110. As a result, the enlarged portions 124 of the lips 122 are not as large.

FIGS. 16-21 illustrate a tray 210 according to a third embodiment, which is similar to the first embodiment with the following modifications. The side walls 216, 217 each include a pair of inner feet 296, each spaced between one of the outer feet 256, 257 and the center of the side wall 216, 217. In the low stack position, the ribs of the side walls rest on one another.

Figure 22:
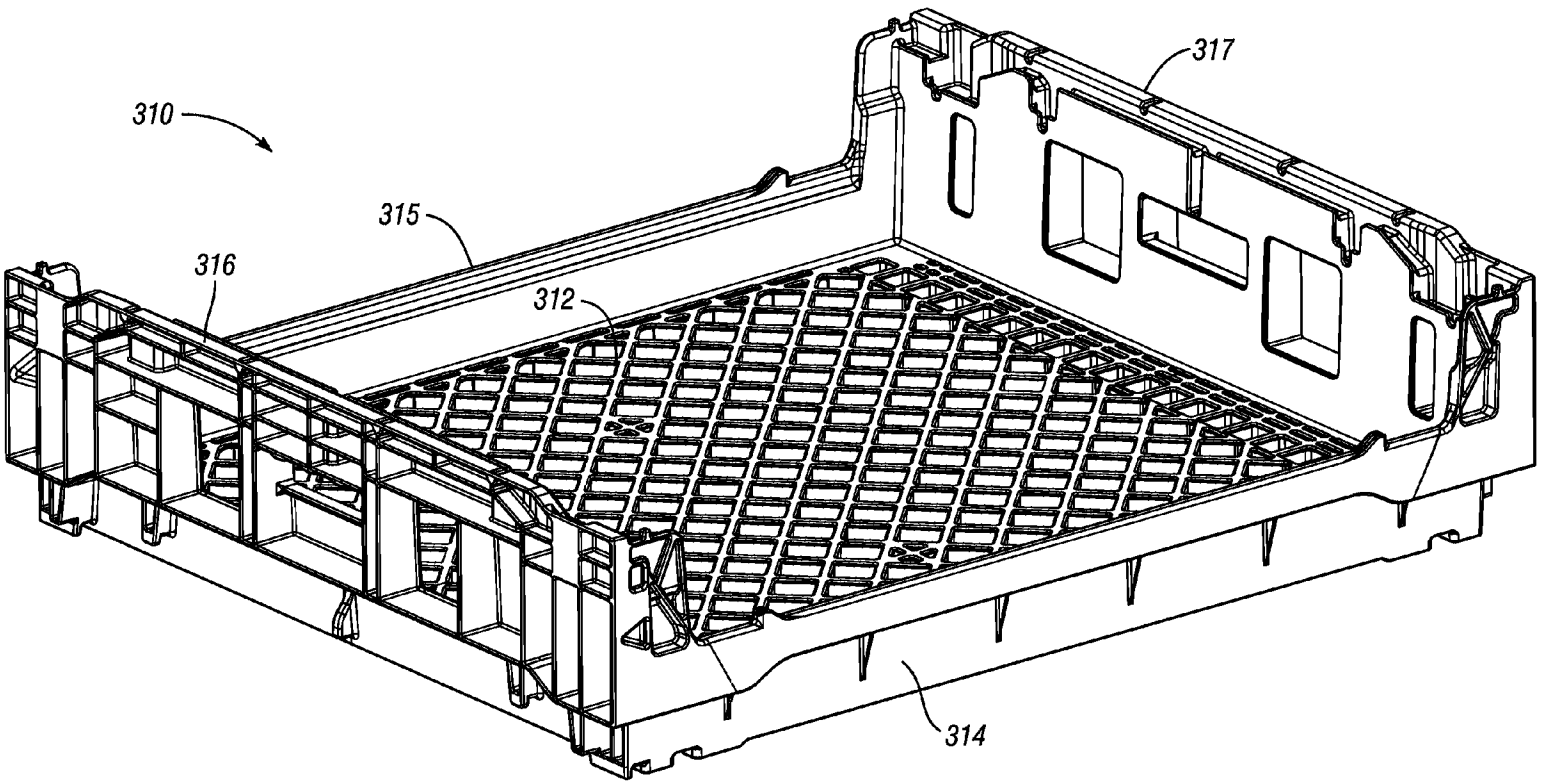
FIG. 22 is a perspective view of a tray according to a fourth embodiment.
Figure 23:
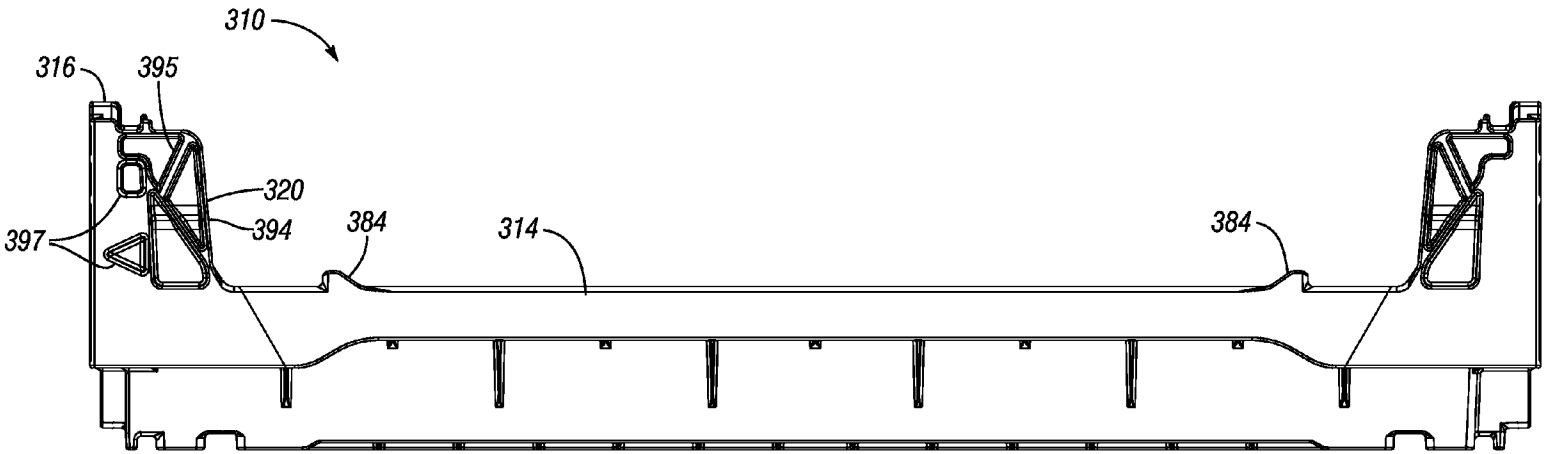
FIG. 23 is a front view of the tray of FIG. 22.
Figure 24:
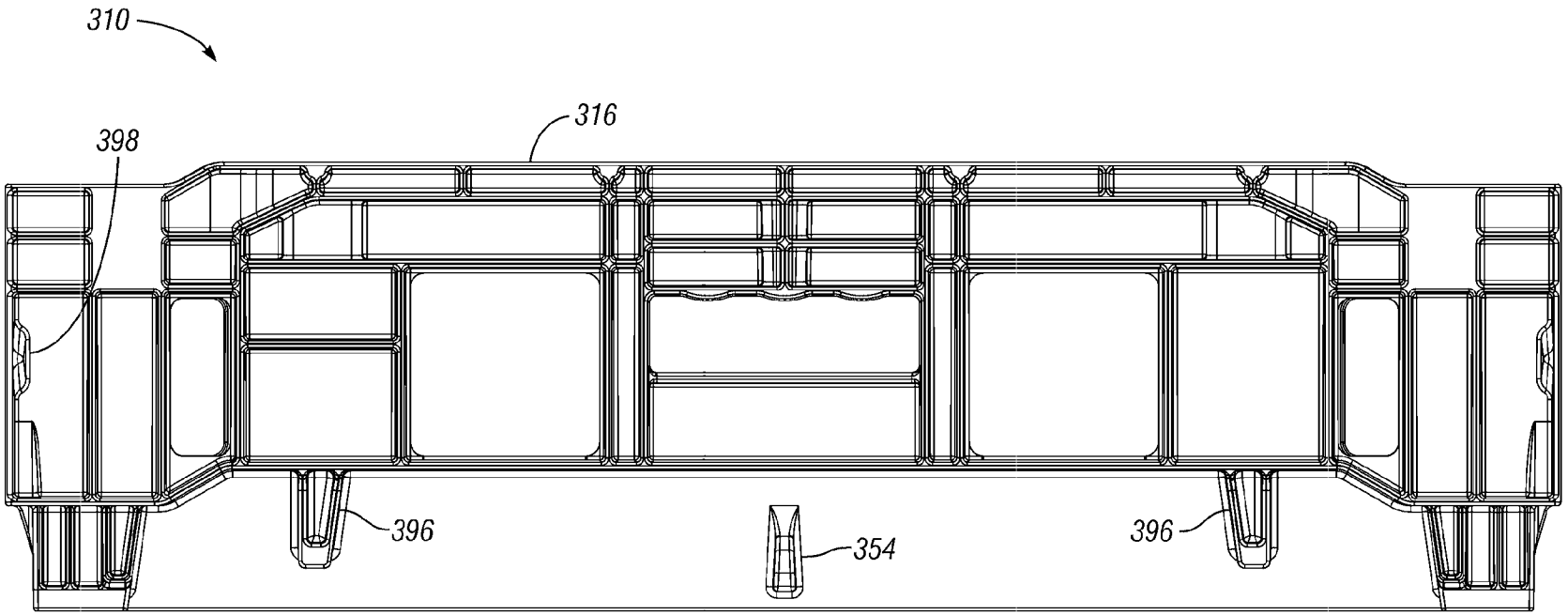
FIG. 24 is a side view of the tray of FIG. 22.

FIGS. 22-24 illustrate a tray 310 according to a third embodiment of the present invention. The tray 310 is identical to the tray 10 of FIGS. 1-12 except as described below or shown in the Figures. Referring to FIG. 22, the tray 310 includes a base 312, side walls 316, 317 and front and rear walls 314, 315. As shown in FIG. 23, the front wall 314 (the rear wall 315 is the same) includes two tabs 384 for interlocking with the cross-stacked trays. Additionally, each of the lateral flanges 320, in addition to the angled rib 394 also includes a transverse rib 395 extending transversely from the angled rib 394 toward an upper interior corner of the lateral flange 320. This increases the strength and rigidity of the lateral flange 320. The front (and rear, not shown) of the tray 310 include visual identifiers molded into one of the lateral flanges 320 so that a user can visually distinguish one side wall 316 from the other side wall 317. This makes it easier to choose the low stacking height (align side wall 316 of one tray with the same side wall 316 on the stacked tray) or the high stacking height (alternate the visual indicators, so that a side wall 316 is stacked on a side wall 317). FIG. 24 is a side view of the tray 310. The tray 310 shown includes the optional inner feet 396 and the optional central projection 354.

The trays 10 are preferably injection molded of polypropylene, polyethylene or other suitable material. Other suitable processes may also be used.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers on method steps are for convenient reference in dependent claims and do not signify a required sequence of performance unless otherwise indicated in the claims.

What is claimed is:

1. A tray comprising:

a base;

a pair of opposed side walls extending upward from the base, the side walls each including an outer rail and an inner rail and a plurality of recesses, wherein each side wall further includes a plurality of feet aligned such that the feet of an identical tray would stack at a first height when stacked in a first orientation relative to the tray and at a second height when stacked at a second orientation relative to the tray;

opposed front and rear walls extending upward from the base, the front wall shorter than the side walls to provide access to an interior of the tray, the front wall having a lip projecting outwardly and downwardly from an upper edge of the front wall, the lip including enlarged portions proximate the side walls to reinforce the tray; and angled gussets including a sloped top edge , the sloped top edge aligned with angled ribs, the angled gussets and angled ribs connecting the front wall to the side walls, wherein the angled ribs extend at a non-zero, acute angle relative to the base, wherein uppermost surfaces of the angled ribs are inclined, relative to the base, at the same angle as the respective sloped top edges of the angled gussets, wherein the angled gussets connect the front wall to the side walls by way of a lateral flange, the angled gussets extending from the lip to the lateral flange, the angled ribs extending from the gussets to the side walls, the angled gussets in direct contact with both the lip and the lateral flange, and the angled ribs in direct contact with both the gussets and the side walls.

2. The tray of claim 1 wherein the lateral flanges extend inwardly from the side walls on the front wall, the angled ribs extending through the lateral flanges.

3. The tray of claim 2 further including a transverse rib extending transversely from each of the angled ribs toward an upper, interior corner of the lateral flange.

4. The tray of claim 1 wherein the enlarged portions of the lip each partially define a box beam cross section opening toward the side walls.

5. The tray of claim 1 further including at least one tab projecting upwardly from the front wall, the tab including a vertical edge toward a nearer one of the side walls, and a tapered end toward a center of the front wall.

* * * * *